US007942977B2

(12) United States Patent
Nistico

(10) Patent No.: US 7,942,977 B2
(45) Date of Patent: May 17, 2011

(54) MOON TROWEL

(76) Inventor: Mario Nistico, Stuyvesant, NY (US)

( * ) Notice: Subject to any disclaimer, the term of this patent is extended or adjusted under 35 U.S.C. 154(b) by 1058 days.

(21) Appl. No.: 11/283,037

(22) Filed: Nov. 18, 2005

(65) Prior Publication Data

US 2006/0073279 A1 Apr. 6, 2006

(51) Int. Cl.
*B05C 17/10* (2006.01)
*B08B 9/087* (2006.01)

(52) U.S. Cl. ..... 134/8; 15/235.4; 15/236.07; 30/169

(58) Field of Classification Search ..... 15/235.4, 15/235.7, 236.01, 236.02, 236.04, 236.07, 15/245.1; 134/6, 8; 30/169; D32/46, 48, D32/49; D8/45
See application file for complete search history.

(56) References Cited

U.S. PATENT DOCUMENTS

| | | | | | |
|---|---|---|---|---|---|
| 392,025 | A | | 10/1888 | Golding | |
| D30,404 | S | | 3/1899 | Booker | |
| 751,356 | A | * | 2/1904 | Smith | 15/235.4 |
| 762,307 | A | * | 6/1904 | Hawksworth | 15/235.4 |
| 1,168,643 | A | * | 1/1916 | Johnson | 15/235.4 |
| 1,264,350 | A | * | 4/1918 | Unsinger | 30/169 |
| 1,325,540 | A | | 12/1919 | Spahr | |
| 2,212,197 | A | | 8/1940 | Roesch et al. | |
| 2,630,591 | A | * | 3/1953 | Smith | 15/105 |
| 2,725,740 | A | * | 12/1955 | Borgstrom | 15/235.4 |
| 3,078,491 | A | | 2/1963 | Ames | |
| 3,267,516 | A | | 8/1966 | Eckhaus | |
| D207,256 | S | * | 3/1967 | Rippl | D32/48 |
| 3,411,723 | A | | 11/1968 | Kohn | |
| 3,604,520 | A | | 9/1971 | Shatto, Jr. | |
| 3,608,944 | A | * | 9/1971 | Turner | 294/3.5 |
| 3,761,992 | A | | 10/1973 | Schneller | |
| 4,253,813 | A | | 3/1981 | Farrell, Jr. | |
| 4,567,616 | A | | 2/1986 | Lyons | |
| 4,669,970 | A | * | 6/1987 | Perry | 425/458 |
| 4,679,275 | A | | 7/1987 | Shannon | |
| 4,784,598 | A | | 11/1988 | Kranz et al. | |
| 4,884,312 | A | | 12/1989 | Clark | |
| 4,919,604 | A | | 4/1990 | Wilson | |
| D327,553 | S | | 6/1992 | Gringer | |
| 5,491,896 | A | * | 2/1996 | Stolzer et al. | 30/169 |
| 5,526,569 | A | | 6/1996 | Ancona | |
| 5,624,145 | A | | 4/1997 | Swilley | |
| 5,626,683 | A | | 5/1997 | Blouin | |
| D383,884 | S | | 9/1997 | O'Shei | |
| 5,799,997 | A | | 9/1998 | Lehn et al. | |
| 6,012,227 | A | | 1/2000 | Lent | |
| 6,202,754 | B1 | * | 3/2001 | Luttrell | 168/48.1 |
| 6,240,591 | B1 | | 6/2001 | Maxted | |
| 6,523,219 | B1 | * | 2/2003 | Anderson | 15/257.01 |
| 7,263,740 | B2 | * | 9/2007 | Crisswell | 15/236.05 |
| 2002/0002754 | A1 | | 1/2002 | Wendel | |
| 2006/0185111 | A1 | * | 8/2006 | Schneble | 15/236.07 |

* cited by examiner

*Primary Examiner* — Randall Chin
(74) *Attorney, Agent, or Firm* — Schmeiser, Olsen & Watts, LLP

(57) ABSTRACT

The invention provides a Moon Trowel apparatus comprising a curved blade configured to make flush contact with the interior wall of a container when the trowel is oriented in a substantially horizontal position and a corresponding method of trowelling using the Moon Trowel apparatus.

11 Claims, 7 Drawing Sheets

MOON TROWEL

CROSS-REFERENCE TO RELATED APPLICATIONS

This application claims benefit to non-provisional U.S. patent application Ser. No. 11/015,802, filed Dec. 17, 2004, now abandoned, which claims benefit to non-provisional U.S. patent application Ser. No. 10/268,389, filed Oct. 10, 2002, now abandoned.

BACKGROUND OF THE INVENTION

1. Field of Invention

The present invention generally relates to an apparatus, and method for trowelling. In particular, the present invention relates to a moon trowel apparatus and corresponding trowelling method.

2. Related Art

The Moon Trowel will be a useful and efficient tool to anyone involved in the construction field.

It retrieves material such as joint compound for sheetrock (tapers trade), cement or mortar including thin set mortar for ceramic tile (masonry and laborers trade) and tar (roofers trade) out of five gallon buckets with absolutely zero waste. All the material inside the bucket is efficiently retrieved. Five gallon buckets are the most commonly used because they are so abundant and are just the right size for handling and transporting materials from one place to another.

Presently, and prior to my invention, the only tool available to get materials out of a five gallon bucket is any trowel with a straight edged blade. Using a straight edged tool to get something out of a round bucket is awkward, time consuming, and wasteful.

The marketing of the Moon Trowel will save contractors and do-it-yourselfers time and money.

SUMMARY OF THE INVENTION

The present invention provides a moon trowel apparatus having specific blade characteristics and a corresponding method of trowelling.

One aspect of the present invention is an apparatus comprising a blade having a curved edge, said curved edge configured to effectuate substantial length mating with the wall of a cylindrical container when the blade is positioned in a substantially horizontal orientation; a handle attached to the blade; and an elevation section located between the blade and the handle, wherein the elevation section positions the handle in a lengthwise planar orientation above a plane corresponding the blade.

A second aspect of the present invention is a method comprising providing a moon trowel including a curved blade configured to make flush contact with the interior wall of a container when the trowel is oriented in a substantially horizontal position; holding the moon trowel in a substantially horizontal position with the blade in a plane substantially parallel with the bottom surface of a container; scraping materials onto the blade of the moon trowel by moving the moon trowel in a horizontal direction within the container; removing the materials from the container via manipulation of the moon trowel, wherein the trowel remains in a substantially horizontal orientation during manipulation; and applying the removed materials to a construction project.

A third aspect of the present invention is a method comprising providing a trowel having an elevation section between a handle and a blade having a curved edge, said curved edge configured to effectuate substantial length mating with the wall of a cylindrical container when the blade is positioned in a substantially horizontal orientation, wherein the elevation section positions the handle in a lengthwise planar orientation above a plane corresponding the blade; gripping the trowel with a human hand such that fingers extend to an underside portion of the handle; positioning trowelling materials residing in a container on the blade via movement of the trowel within the container; removing the trowelling materials from the container, wherein the removal process maintains substantial length mating of the curved edge of the trowel with an interior wall of the container until the trowel is fully out of the container; and putting the trowelling materials onto a work project.

BRIEF DESCRIPTION OF THE DRAWINGS

The features of the present invention will best be understood from a detailed description of the invention and an embodiment thereof selected for the purpose of illustration and shown in the accompanying drawings in which.

DETAILED DESCRIPTION OF THE INVENTION

Figure 1:
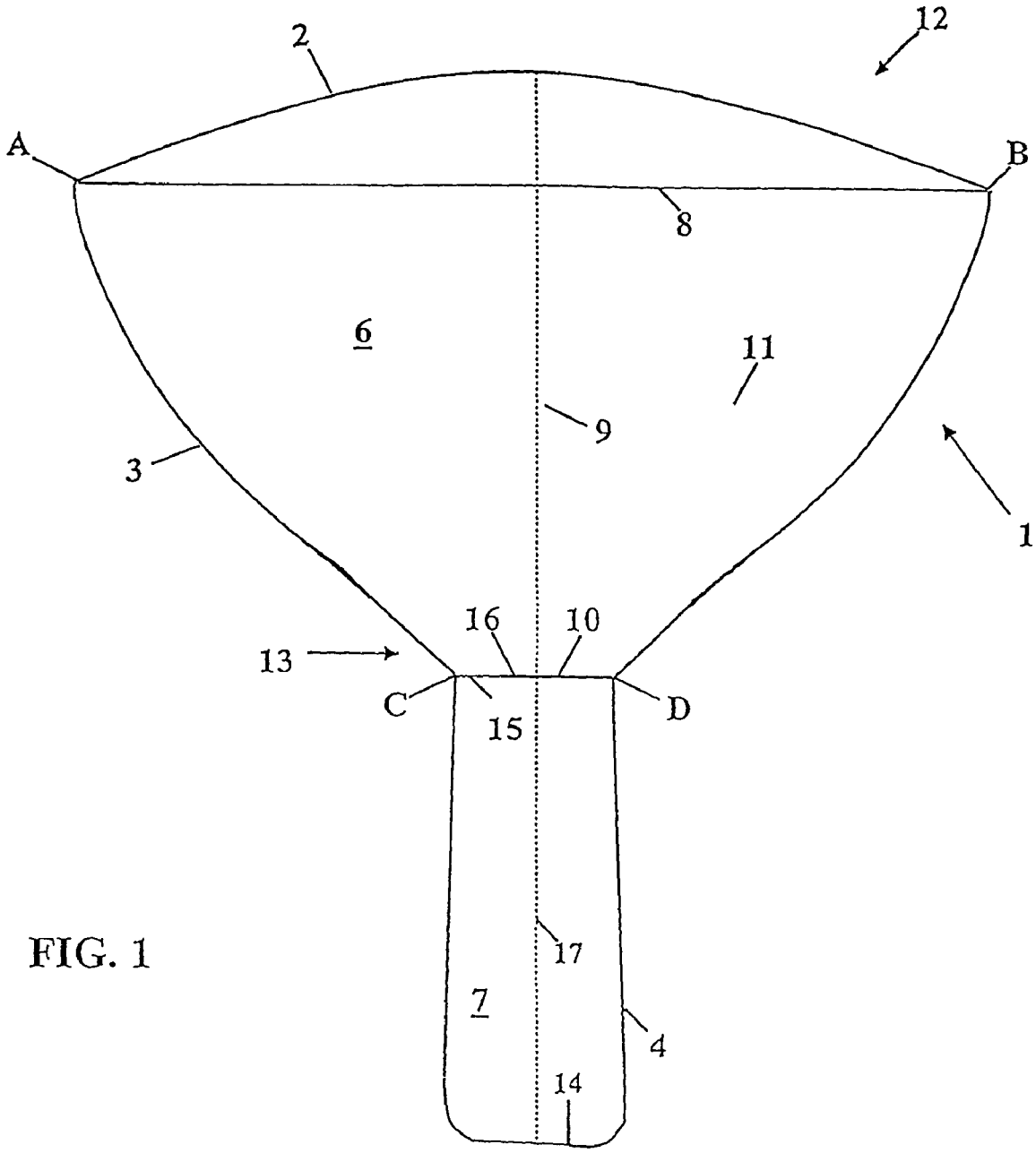
FIG. 1 depicts a front view of an embodiment of a moon trowel apparatus, in accordance with the present invention.

Although certain embodiments of the present invention will be shown and described in detail, it should be understood that various changes and modifications may be made without departing from the scope of any appended claims. The scope of the present invention will in no way be limited to the number of constituting components, the materials thereof, the shapes thereof, the relative arrangement thereof, etc . . . , and are disclosed simply as an example of an embodiment. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

FIG. 1 depicts an embodiment of a Moon Trowel 1 that is a very simple tool; Simple to both use and make. The Moon Trowel 1 comprises: a blade 6 and a handle 7. The blade 6 may have a planar surface 11, wherein a first portion 12 of a perimeter of the blade 6 may have a first convex shaped edge 2, wherein the first convex shaped edge 2 may have a first end A and a second end B, and wherein a first transverse line 8 may connect the ends, A and B, of the first convex shaped edge 2 and the first transverse line 8 may be orthogonal to a longitudinal axis 9 of the blade 6. The handle, 7 may extend from a second portion 13 of the perimeter of the blade 6, wherein the handle 7 may have a proximal end 15 that is closest to the second portion 13 of the perimeter of the blade 6 and a distal end 14 that is farthest from the second portion 13 of the perimeter of the blade 6. The handle 7 may also have edge 4, wherein edge 4 may be a thickness of the handle 7. A second transverse line 16 of the blade 7 may extend from a first end C and a second end D of the second portion 13 of the perimeter of the blade 6. The second transverse line 16 may be coplanar with the proximal end 15 of the handle 7 and parallel to the first transverse line 8, wherein a longitudinal axis 17 of the handle 7 may be coplanar with the longitudinal axis 9 of the blade 6. Sides 3 of the blade may form a relatively smooth convex curve between respective ends A and B of the first convex shaped edge 2 and the ends C and D of the second transverse line 16. To use it, grasp the tool 1 by the handle 7 and use it to retrieve whatever material you need to get out of a five gallon bucket. The blade 6 is shaped to meet and match the inside walls of a five gallon bucket. When retrieving materials with the Moon Trowel 1, you press the blade 6 of the trowel 1 against the inside of the bucket and using an upward motion, scrape the walls of the bucket clean. By the time the materials are used up, the Moon Trowel 1 will have scraped out ALL (100%) of the material from the inside of the bucket.

A particular embodiment of making an embodiment of the Moon Trowel 1 may be just as easy as using it. To make or manufacture it, all you may need to do is design a concave shaped die in which you stamp out a convex shaped blade 6, as depicted in FIG. 1 and described herein. The die in this case will have a concave curve of 5⅝" radius. When the die stamps the blade 6, you are left with a convex shaped blade 6 consisting of the same 5 ⅝" radius curve.

In the past and present, anyone wishing to get materials out of a five gallon bucket has to settle for a trowel with a straight blade. This would be ideal if the materials came in square five gallon buckets with flat straight sides, but they don't. They come in round five gallon buckets with curved sides.

A specific improvement is really the shape of the blade 6, as depicted in FIG. 1 and described herein.

Figure 2:
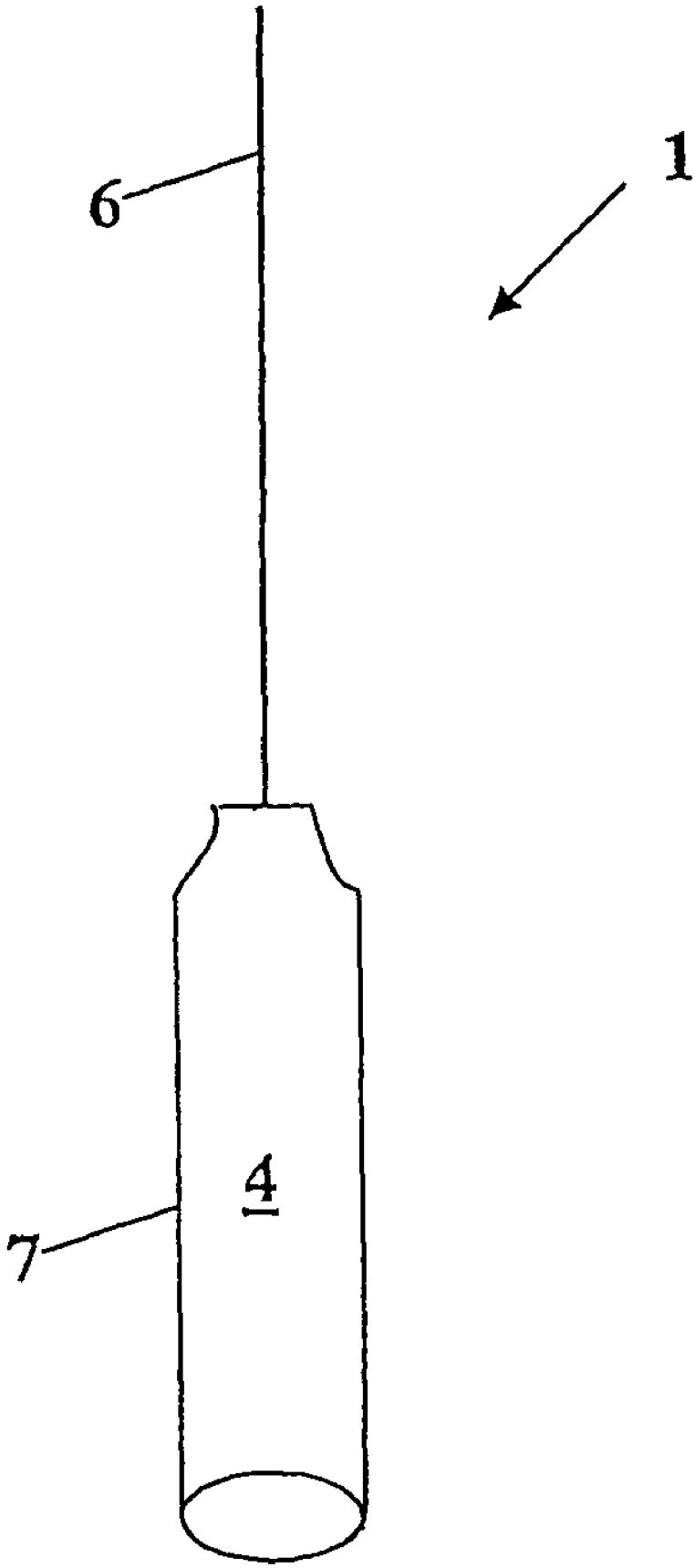
FIG. 2 depicts a side view of an embodiment of a moon trowel apparatus, in accordance with the present invention.

FIG. 2 shows an embodiment of the Moon Trowel 1 side view. The blade 6 may be four inches from the top of the handle to the top of the curve of the blade 6. The total length of the Moon Trowel 1 may be eight inches. The handle 7 may be ¾ of an inch thick.

To trowel efficiently, it is critical that materials being applied by the trowel be effectively positioned on the trowel. Where materials are being retrieved by a trowel from round containers, in particular five gallon buckets, it becomes difficult to trowel if the materials cannot be efficiently retrieved or if the materials do not remain positioned on the trowel.

Figure 3:
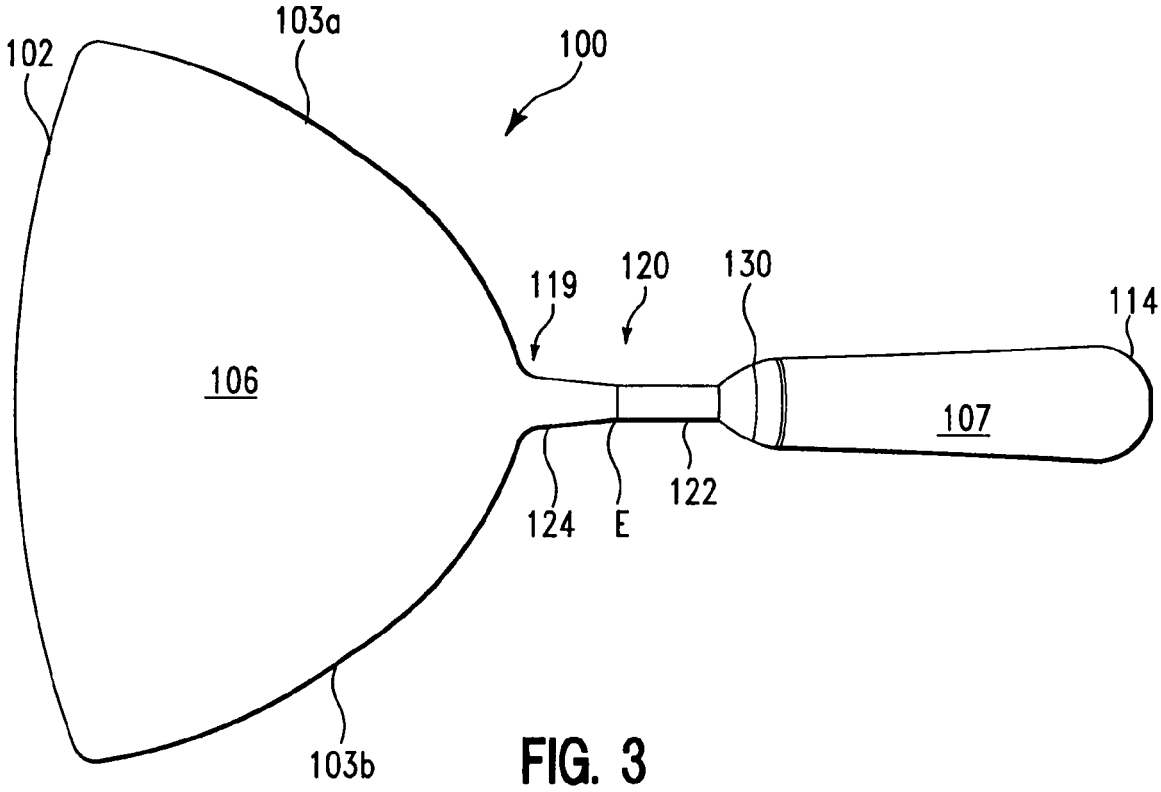
FIG. 3 depicts a front view of another embodiment of a moon trowel apparatus, in accordance with the present invention.

FIG. 3 depicts another embodiment of a Moon Trowel apparatus. The trowel may comprise a blade 106. The blade 106 may include a convexed or curved edge 102. The edge 102 may be curved, shaped, molded, cut, stamped, milled, shaved, grinded, forged, or otherwise fashioned to mate, touch or substantially align with the interior wall of a bucket; particularly the edge 102 may be configured to have substantially the same radius as a curved shaped cylindrical edge of the interior of a five-gallon bucket. The blade may be made of metals, alloys, hard plastics, hard woods, composites, or other rigid or semi-rigid materials that may adequately effectuate trowelling. Extending from the outer edge 102 may be side edges 103*a* and 103*b*. Side edges 103*a-b* may be oppositely symmetrical, but need not be. Moreover, side edges 103*a-b* may be curved, convexed, straight, concaved or configured with polygonal facets. Furthermore, the edges 103*a-b* may converge to a base 119. The base 119 may be an effective propagation point for the planar surface comprising blade 106. In addition, the base 119 may also be coupled to, attached to, joined with, or formed integrally as from a single piece with an upward extending member 124. The upward extending member 124 may be formed of the same material as the blade 106, or may be formed of other similar and suitably effective material.

Figure 4:
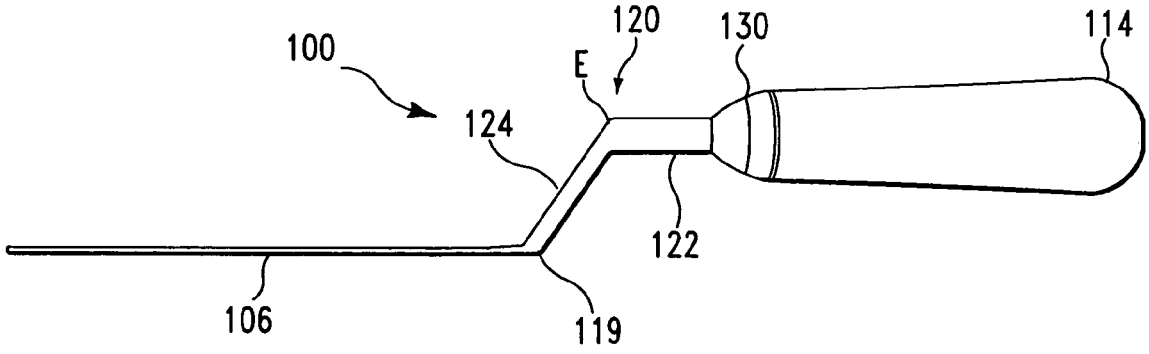
FIG. 4 depicts a side view of another embodiment of a moon trowel apparatus, in accordance with the present invention.

As shown further in FIG. 3 and with additional reference to FIG. 4 depicting a side view of the embodiment of a moon trowel apparatus 100, the upwardly extending member 124 may join an extension member 122 at a junction E. The upward propagation of the upwardly extending member 124 may be in any angled direction referenced against the planar surface of blade 106. For example, the upwardly extending member may extend at around a 60° (degree) angle from the base 119 of blade 106. The extension member may be coupled to, attached to, joined with, or formed integrally as from a single piece with an upward extending member 124. Moreover, the extension member may be coupled to, attached to, joined with, or formed integrally as from a single piece with a handle 107. The attachment of the extension member 122 to the handle 107 may be facilitated by an attachment element 130. In addition, the extension member may also be positioned within the handle 107 to any depth and/or width sufficient to effectively retain the extension member as ultimately coupled to the blade 106 in operable position with the handle 107. For instance, the handle 107 may be comprised of two segmented halves securely joined together having the extension member affixed therebetween. In addition, the handle may have a rounded, chamfered, beveled, or angled distal end 114.

The portion of the moon trowel apparatus 100 comprising the segment between the handle 107 and the blade 106 may generally be referred to as the elevation section 120. The elevation section may position the handle 107 in a lengthwise planar orientation above a plane corresponding to the blade 106. Operably located within this section may be the junction E, which may be positioned at any locale relative to the various configurations of the extension member 122 and upwardly extending member 124 as joined thereat.

Figure 5:
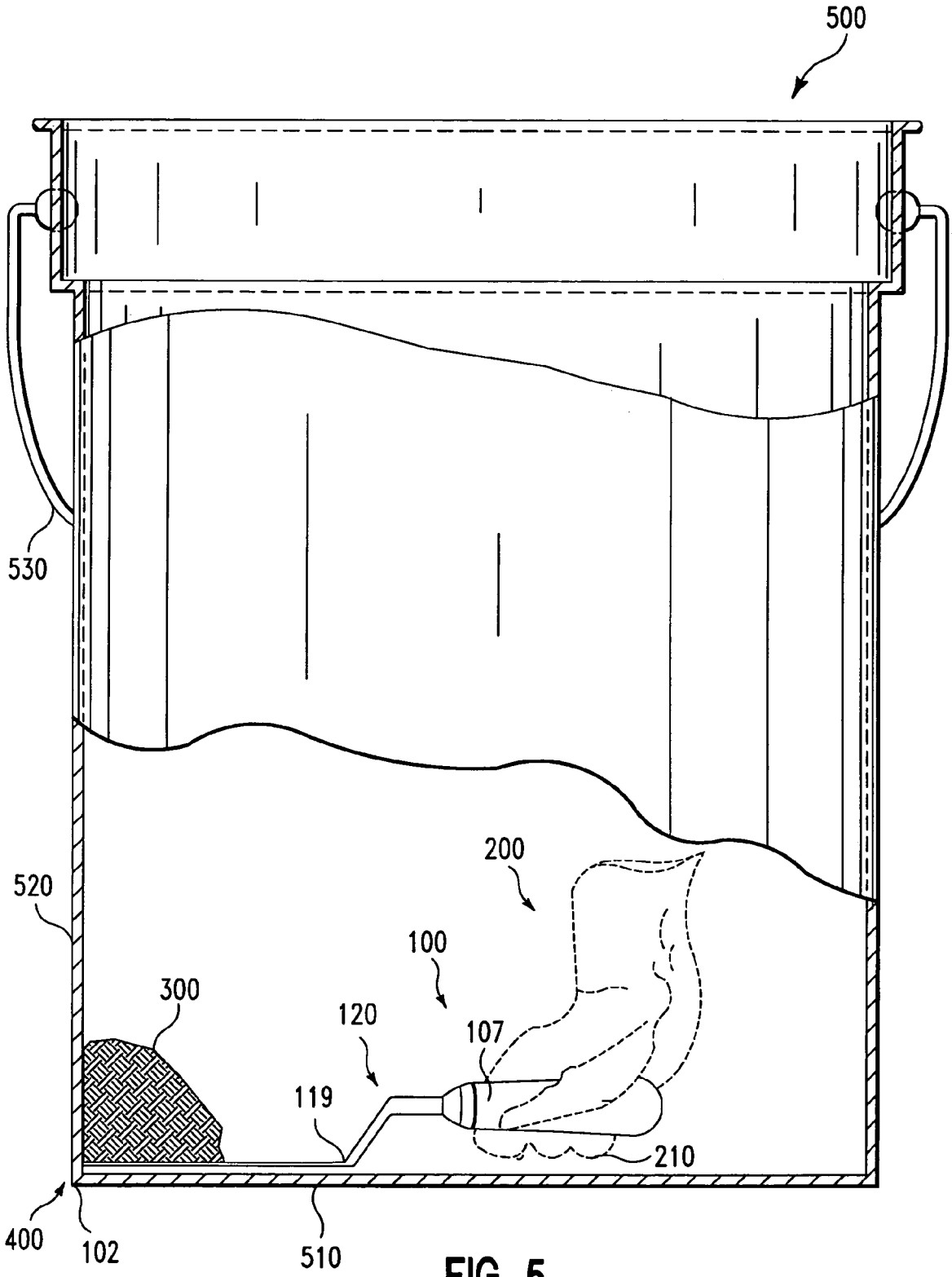
FIG. 5 depicts a cut-away perspective view of an embodiment of a moon trowel being appropriately used, in accordance with the present invention.

With continued reference to the drawings, FIG. 5 depicts a cut-away perspective view of an embodiment of a moon trowel 100 being appropriately used. Accordingly a user may grasp the moon trowel 100 with their hand 200 (depicted in broken lines). Although a right hand is depicted, those in the art should appreciate that the moon trowel apparatus and corresponding methods of trowelling may be effectively accomplished via a user holding, manipulating, using, grasping, working and/or operating the tool with a left hand.

Referring further still to FIG. 5, a moon trowel 100 may operate with and/or within a cylindrical container 500. The cylindrical container 500 may be a bucket, a can, a drum, a barrel, or other like vessel. For example, the cylindrical container 500 may be a five-gallon bucket. Accordingly, the cylindrical container may have a bottom side 510 and a cylindrical side 520. The cylindrical container may be comprised of plastics, metals wood or similar materials capable of effectively holding trowelling materials 300 such as joint compound, mortar, tar, mud, polymeric material, epoxy, stucco compound, paste, cement, grout and/or other like materials. The container 500 may also include a pivotal handle 530 fastened thereto. Those in the art may appreciate that trowelling materials often reside in five-gallon buckets.

With continued reference to FIG. 5, the appropriate use of the moon trowel 100 involves substantial length mating 400 of the of edge 102 of the blade 106 with the cylindrical edge 520 of the cylindrical container 500, when the plane of blade 106 resides in a plane substantially parallel with the plane corresponding to the bottom edge 510 of the cylindrical container 500. In other words, the base 119 of the blade 106 should be positioned at a distance substantially equal with a similar distance of the edge 102 of the blade 106 when the edge 102 is located at any position on or above the surface of the bottom edge 510 of the cylindrical container 500. In still other words, the trowel 100 should be oriented so that the blade 106 is substantially horizontal when substantial length mating 400 of the edge 102 of the blade 106 occurs with the cylindrical edge 520 of the cylindrical container 500. Substantial length mating 400 may be understood to mean that the edge 102 is significantly flush with, largely positioned against, or making substantial communication with the cylindrical edge 520 of the cylindrical container 510.

As can be seen further in FIG. 5, when a user grasps the handle 107 of the embodiment of the moon trowel 100 the user's fingers may reside underneath the handle 107 in an area between the handle 107 and the bottom surface 510 of the container 500. This orientation of the fingers may allow a user to firmly grasp a moon trowel 100 while positioning the blade 106 flat against or substantially near the bottom surface 510 of the container 500. This may enable the user to scrape, pile, scoop or otherwise position substantially all the trowelling materials 300 residing in the container 500 onto the trowel 100. However, those in the art will appreciate that other embodiments such as moon trowel 1, which do not have an elevation section, may also be grasped and manipulated by a user to position substantially all the trowelling materials onto the trowel 1. The user would accordingly need to grasp the trowel 1 such that fingers 210 do not cause the trowel to be misaligned in a plane not substantially parallel with the bottom surface 510 of the cylindrical container 500.

Figure 6:
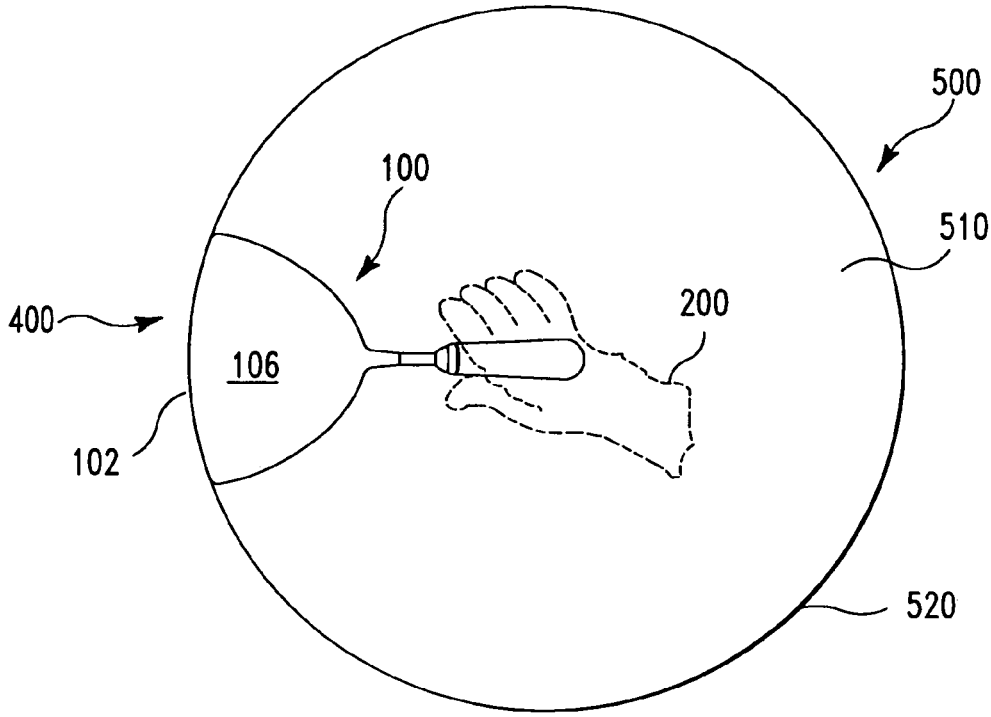
FIG. 6 depicts a top view of an embodiment of a moon trowel being appropriately used, in accordance with the present invention.

With further reference to the drawings, FIG. 6 depicts a top view of an embodiment of a moon trowel 100 being appropriately used. In clear view is the substantial length mating 400 of the blade 106 edge 102 with the cylindrical wall or edge 520 of the container 500. Moreover, when the user appropriately holds the trowel 100 in an orientation such that the trowel is substantially horizontal, the trowel 100 may be pushed down upon, set flat over, and/or rest directly on top of the bottom surface 510 of the container 500. For example a user may grasp the trowel 100 and reach down into a five-gallon bucket 500 and push the trowel 100 flat against the bottom 510 and flush against the cylindrical edge 520 simultaneously.

Figure 7:
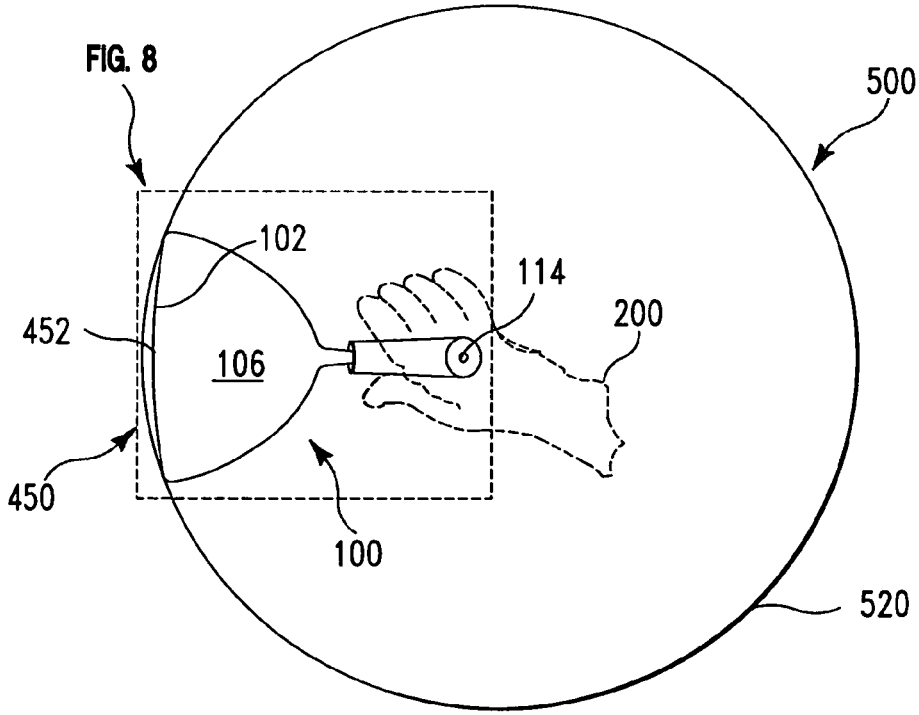
FIG. 7 depicts a top view of an embodiment of a moon trowel being inappropriately used, in accordance with the present invention.

In contradistinction, FIG. 7 depicts a top view of an embodiment of a moon trowel 100 being inappropriately used, in accordance with the present invention. As can be seen, the trowel 100 is oriented at an angle such that the rounded, chamfered portion of the distal end is exposed to a top view, where the user's hand 200 is portrayed in broken lines as a ghosted image. When the trowel 100 is not held substantially horizontally, communication or contact between the edge 102 of the blade 106 and the cylindrical wall 520 results in only partial length mating 450. This partial length mating renders a corresponding gap 452 positioned between the cylindrical wall 520 and the edge 102 of the blade 106. The gap 452 is unacceptable and incompatible with the objects of the present invention.

Figure 8:
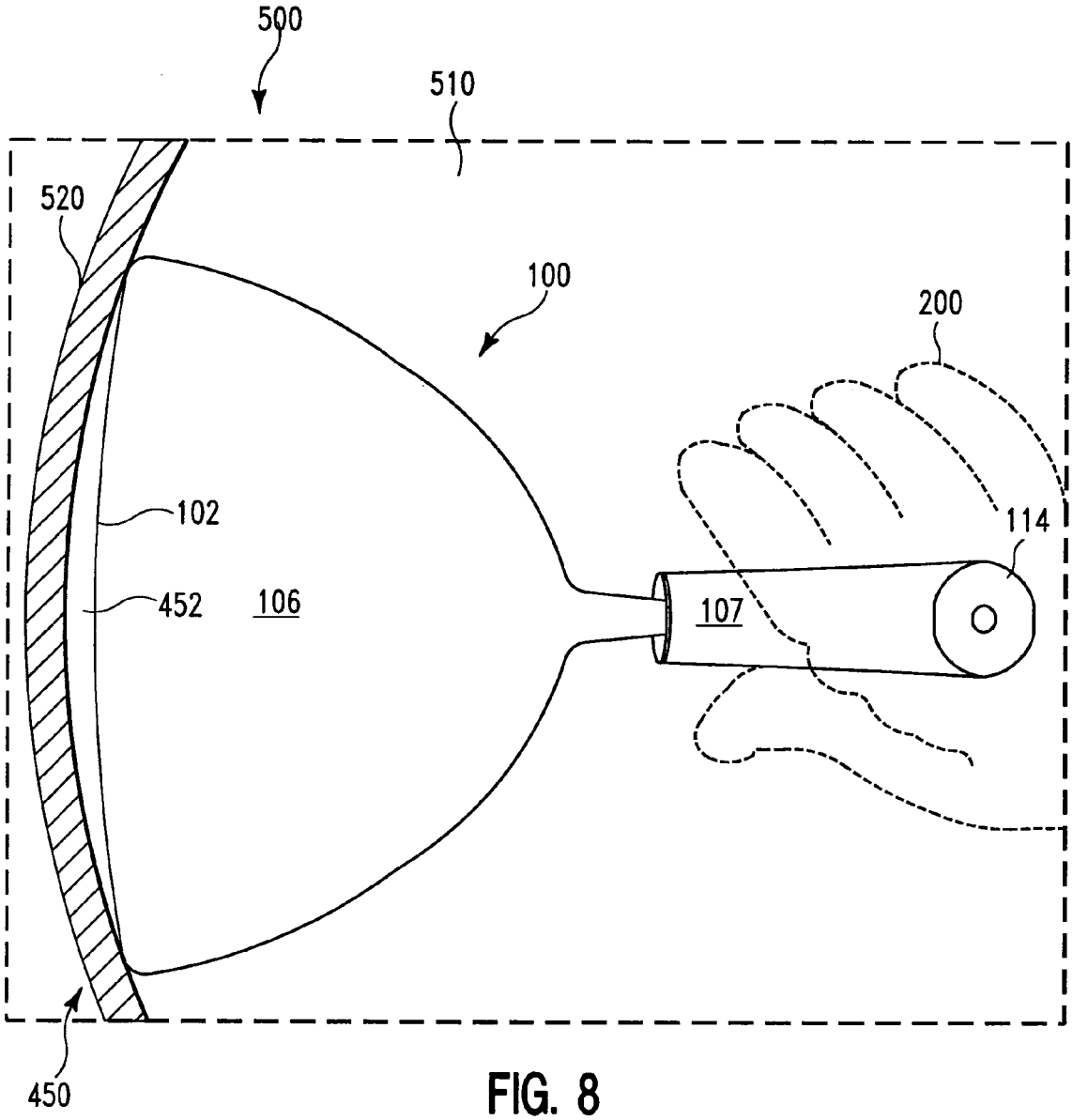
FIG. 8 depicts a blown-up top view of an embodiment of a moon trowel being inappropriately used, in accordance with the present invention.

To provide greater clarity, FIG. 8 depicts a blown-up top view of the embodiment of a moon trowel 100 being inappropriately used as shown in FIG. 7. Where the handle 107 is angled upward from the bottom surface 510 of the container such that the distal end is exposed to a top down view, it is clear that the edge 102 of the blade 106 operates with the cylindrical wall 520 to effectuate only partial length mating 450. A crescent shaped gap 452 accordingly extends between minimal contact portions on the outer portions of the edge 102 with the wall 520. Hence, if a user grasps the tool with a hand 200 and inefficiently manipulates it in an angled orientation within the container 500, the trowel could not make flush substantial length mating 400 (shown in FIGS. 5 and 6) with the wall 520 of the container 500.

Figure 9:
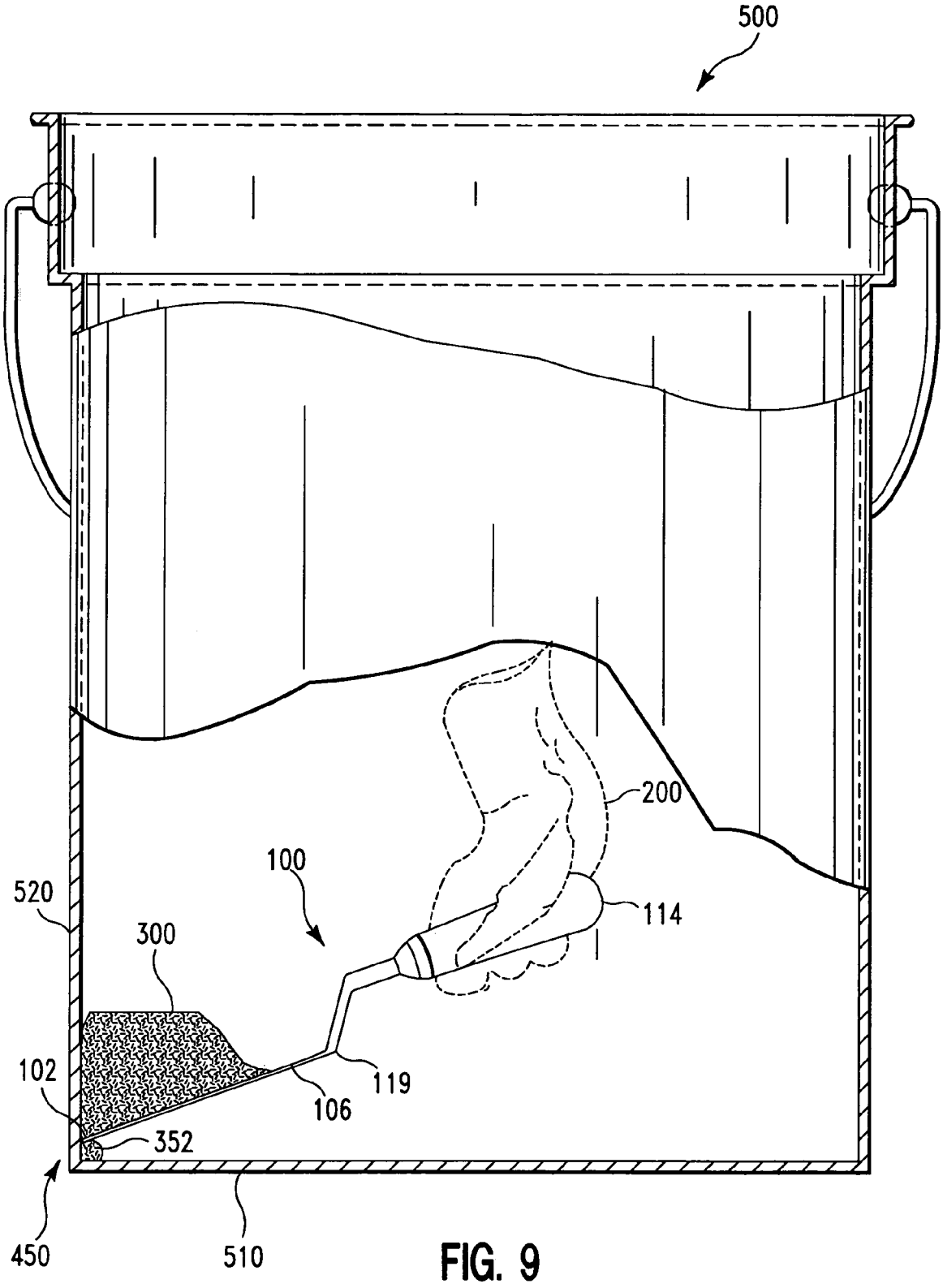
FIG. 9 depicts a cut-away perspective view of an embodiment of a moon trowel being inappropriately used, in accordance with the present invention.

Inefficiencies of trowel usage are emphasized to some extent in FIG. 9, which depicts a cut-away perspective view of an embodiment of a moon trowel 100 being inappropriately used. As shown a user may utilize a hand 200 to grasp the moon trowel 100 and orient the trowel 100 such that the blade 106 is positioned at an angle with respect to the bottom surface 510 of the container 500 wherein the distal end 114 points upward away from the bottom surface 510 of the container 500. Such an angled positioning is ineffective. As shown previously in FIGS. 7 and 8, a gap 452 between the container wall 520 and the blade edge 102 forms when the moon trowel 100 is oriented such that the blade 106 resides in planar positions other than substantially horizontal rendering only partial length mating 450. As a result, trowelling materials 300 may leak down through the gap leaving material deposits 352 in the container 500. Hence a user could not efficiently utilize the moon trowel to collect, gather scoop, scrape or otherwise position substantially all of the trowelling materials 300 on the trowel because of the gap 452 which permits leaking. This leakage problem may be especially acute when using lower viscosity trowelling materials 300 such as soupy mud, cement, grout mixtures or other runny trowelling materials. For example, if a trowel 100 is manipulated at an improper angle within a five-gallon bucket containing soupy tile grout 300, then the tile grout 300 may run through the gap 452 formed between the interior wall 520 of the bucket 500 and the edge 102 of the improperly oriented trowel 100 and pool into an unwanted and inefficient deposit 352 at the bottom of the bucket. Such unwanted deposits would oblige a trowel user to make multiple, inefficient attempts to remove the leaky grout 352 from the bucket 500 taking more time and costing expenditures of additional energy.

Those in the art will appreciate that a gap 452 and partial length mating may result if the trowel 10 or 100 or other embodiments are oriented such that the handle 107 is at an angle below the blade 106 with respect to the bottom 510 of the container. Moreover, those in the art should also appreciate that while trowel tools may be designed with curved blades that effectuate substantial length mating when the trowel is held at an angle, such mating still does not obviate inefficiencies corresponding to the planar orientation of the blade. Once, such a tool (designed to have an edge make flush contact with the container when held at an angle) is removed from the container, the trowelling materials positioned on the blade would tend to slide, slip, spill or otherwise be undesirably removed from the blade via the effects of gravity. Such spills, etc. would create additional problems that a trowel user would need to deal with or attempt to compensate for if using an improperly designed and wrongly oriented trowel.

In addition, it should further be recognized that while trowel tools may be configured with blades having smaller radial curved edges than corresponding containers, such tools would suffer from spillage of trowelling materials 300 off the edges of the blade that would not fully mate with the wall of the container within which they may be operated. Blades having larger radial curved edges than corresponding containers would suffer from existence of inherent gaps when attempts to mate with container walls are made. Still further, it is envisioned that embodiments of the moon trowel may be designed without a handle and only including a blade with a gripping surface capable of positioning the blade horizontally. Hence, it is understood that for optimal trowelling, a moon trowel may be provided for usage in horizontal orientation.

Various modifications and variations of the described apparatus and methods of the invention will be apparent to those skilled in the art without departing from the scope and spirit of the invention. Although the invention has been described in connection with specific embodiments, outlined above, it should be understood that the invention should not be unduly limited to such specific embodiments. Various changes may be made without departing from the spirit and scope of the invention as defined in the following claims.

I claim:

1. A moon trowel apparatus comprising:

a blade having a flat planar surface, a curved first edge, and side edges, said curved first edge having a radius of curvature of 5 and ⅝ inches so as to match the radius of curvature of an interior side-wall surface of a standard cylindrical five-gallon bucket having a flat bottom surface, wherein the 5 and ⅝ inch radius curved first edge is configured to effectuate flush contact between the curved first edge of the blade and the interior side-wall surface of a standard cylindrical five-gallon bucket so as to mate with the interior side-wall surface of the bucket along the length of the curved first edge when the flat planar surface of the blade is positioned within the standard cylindrical five-gallon bucket so that the flat planar surface of the blade resides in a substantially horizontal orientation parallel to the flat bottom surface of the standard cylindrical five-gallon bucket, and further wherein said side edges of the blade extend to a base of the blade located opposite the curved first edge of the blade; and a handle attached to an elevation section of the trowel, wherein the handle extends from the elevation section of the trowel;

wherein the elevation section is located between the base of the blade and the handle, the elevation section being connected to the base of the blade and extending at an acute angle from the base of the blade, the acute angle referenced against the plane of the flat planar surface of the blade, and further wherein the elevation section positions the handle in a plane other than that of the flat planar surface of the blade.

2. The moon trowel apparatus of claim 1, further comprising an upward extending member and an extension member, wherein the upward extending member and the extension member join at a junction and unitedly reside in the elevation section.

3. The moon trowel apparatus of claim 2, wherein a portion of the extension member securely resides within at least a portion of the handle.

4. The moon trowel apparatus of claim 1, wherein the side edges of the blade have a curved profile.

5. A method of using a moon trowel apparatus, the method comprising:

providing a moon trowel including a blade having a flat planar surface, a curved first edge, and side edges, said curved first edge having a radius of curvature substantially similar to the curvature of an interior side-wall surface of a standard cylindrical five-gallon bucket having a flat bottom surface, wherein the curved first edge is configured to effectuate flush contact between the curved first edge of the blade and the interior side-wall surface of a standard cylindrical five-gallon bucket when the flat planar surface of the blade is positioned in a substantially horizontal orientation, and further wherein said side edges of the blade extend to a base of the blade located opposite the curved first edge of the blade;

providing a handle attached to an elevation section of the trowel, wherein the handle extends from the elevation section of the trowel;

wherein the elevation section is located between the base of the blade and the handle, the elevation section being connected to the base of the blade and extending at an acute angle from the base of the blade, the acute angle referenced against the plane of the flat planar surface of the blade, and further wherein the elevation section positions the handle in a plane other than that of the flat planar surface of the blade;

providing a standard cylindrical five-gallon bucket having a flat bottom surface and containing trowelling materials; and using the moon trowel to remove the trowelling materials from the bucket.

6. The method of using a moon trowel apparatus of claim 5 further comprising positioning trowelling materials residing in the bucket on the blade via movement of the trowel within the bucket, wherein the movement of the trowel within the bucket occurs at the very bottom surface of the bucket.

7. The method of using a moon trowel apparatus of claim 5, further comprising gripping the trowel with a human hand such that fingers extend to an underside portion of the handle, wherein gripping the trowel occurs when the trowel blade is resting flat against the bottom surface of the bucket.

8. The method of using a moon trowel apparatus of claim 5, wherein the elevation section of the trowel further includes an upward extending member and an extension member joined at a junction.

9. The method of using a moon trowel apparatus of claim 5, wherein the side edges of the blade have a curved profile.

10. The method of using a moon trowel apparatus of claim 5, wherein a portion of the extension member securely resides within at least a portion of the handle.

11. The method of using a moon trowel apparatus of claim 5 further comprising removing the trowelling materials from the bucket, wherein the removal process maintains flush contact between the curved first edge of the blade of the trowel with an interior wall of the bucket until the trowel is fully out of the bucket, wherein removing the trowelling materials further includes orienting the blade such that the flat planar surface of the blade is positioned parallel with the flat bottom surface of the bucket.

* * * * *